US006065151A

United States Patent [19]

Conine, III

[11] Patent Number: 6,065,151

[45] Date of Patent: May 23, 2000

[54] SNAKE BITE PROTECTION GARMENT

[76] Inventor: W. Roy Conine, III, 5731 B Miller Ct., Columbus, Ga. 31909

[21] Appl. No.: 08/675,494

[22] Filed: Jul. 3, 1996

[51] Int. Cl.[7] ..... A41D 17/00; A41D 17/02

[52] U.S. Cl. ..... 2/22; 2/242; 2/46

[58] Field of Search ..... 2/22, 23, 59, 60, 2/122, 123, 46, 227, 242, 231, 2.5, 455, 84

[56] References Cited

U.S. PATENT DOCUMENTS

| | | | |
|---|---|---|---|
| Re. 32,506 | 9/1987 | Hightower . | |
| 1,284,536 | 11/1918 | Yaeger | 2/59 |
| 1,724,413 | 8/1929 | Rauh | 2/242 |
| 2,234,582 | 3/1941 | Schneider | 2/59 |
| 3,269,036 | 8/1966 | Parker et al. . | |
| 3,758,963 | 9/1973 | Knight . | |
| 3,911,913 | 10/1975 | June | 128/142.5 |
| 4,057,853 | 11/1977 | McLane | 2/22 |
| 4,382,301 | 5/1983 | Hightower, Jr. | 2/22 |
| 4,896,437 | 1/1990 | Johnson | 2/22 |
| 5,031,247 | 7/1991 | Carter | 2/242 |
| 5,033,126 | 7/1991 | Wruck et al. | 2/242 |
| 5,170,503 | 12/1992 | Hightower, Jr. et al. | 2/242 |
| 5,173,967 | 12/1992 | Carter | 2/242 |

OTHER PUBLICATIONS

Rattler's Brand® 1994 Catalogue, Thomaston Mills, Inc., Thomaston, Georgia.

Advertisement of Rattler's Brand® entitled "Snake Proof Chaps", Thomaston Mills, Inc., Thomaston, Georgia. (No date available).

Advertisement of Rattler's Brand® entitled "Care Instructions For Camo Clothing", Thomaston Mills, Inc., Thomaston, Georgia. (No date available).

*Primary Examiner*—Jeanette E. Chapman

*Attorney, Agent, or Firm*—Kilpatrick Stockton LLP; Dean W. Russell; Richard A. Clegg

[57] ABSTRACT

An improved snake-proof chap is disclosed, for protecting a wearer against snake-bite. The chap is made of a spun polyester duck fabric having a weight between about 14–16 ounces per square yard, coated on its inner surface with a neoprene coating, and includes an improved closure system for closing a slit at the lower end of the chap.

4 Claims, 4 Drawing Sheets

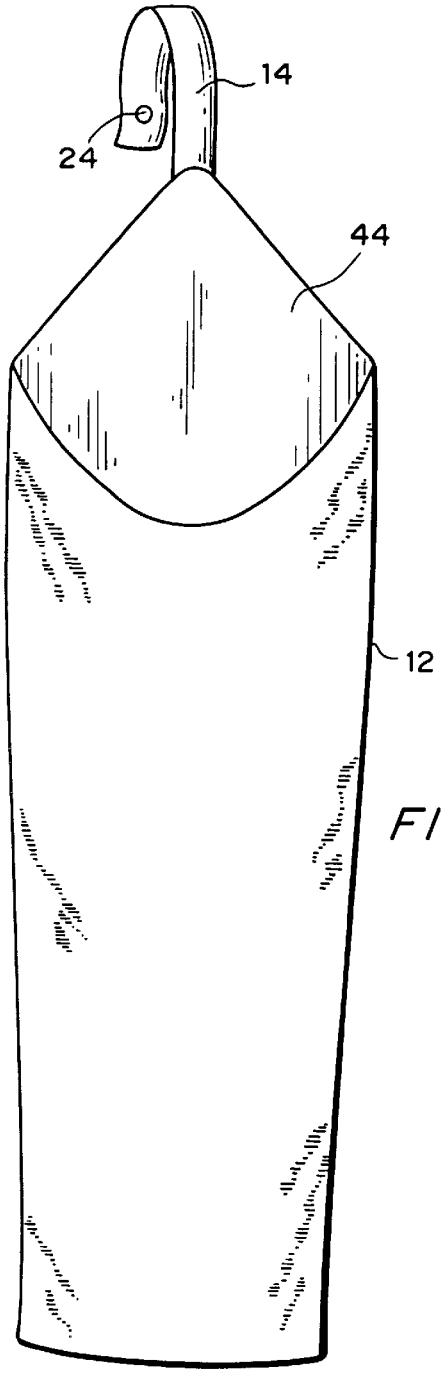
FIG. 3
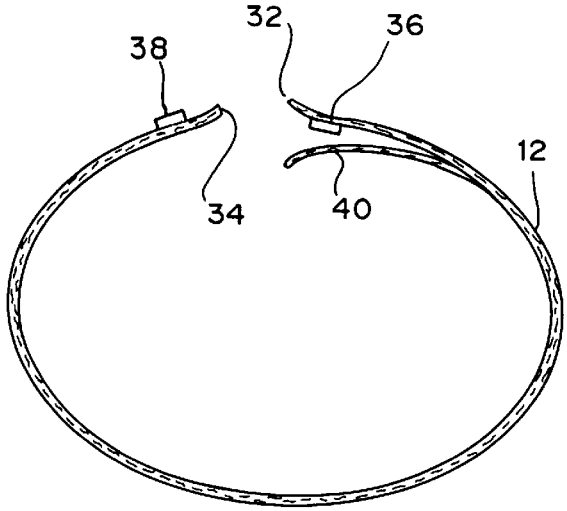
FIG. 4
FIG. 5
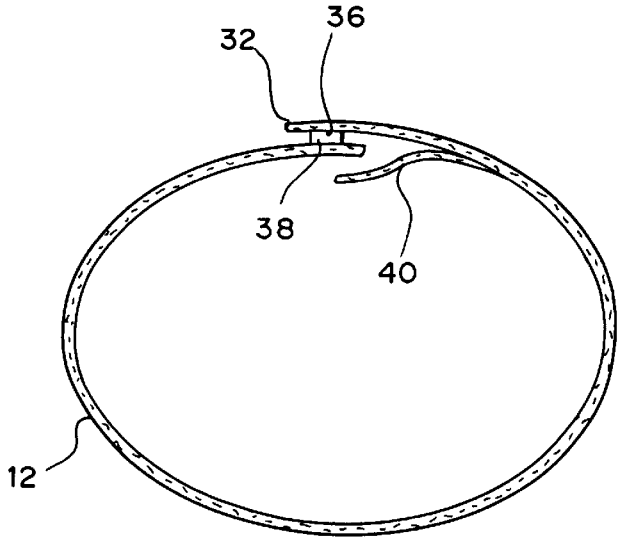

SNAKE BITE PROTECTION GARMENT

FIELD OF THE INVENTION

The present invention relates generally to the field of devices for protecting persons against snake bite during outdoor activities such as hiking and hunting. More specifically, the invention is an improved fabric legging for protecting a wearer's leg from snake bite.

BACKGROUND OF THE INVENTION

Through the years, a variety of different protective leggings have been developed for protecting persons against snake bites when walking through heavy undergrowth areas.

Some approaches for protecting persons from snake bites have been based upon the use of a rigid material to surround the wearer's legs. For instance, U.S. Pat. No. 3,269,036, issued to Parker et al on Aug. 30, 1966, discloses a protective legging including a protective sheet made of aluminum or similar material. Other leggings have been used that are made of fiberglass or hard plastic material. U.S. Pat. No. 4,057,853, issued to McLane on Nov. 15, 1977, discloses a protective legging having a double layer of closely woven stainless steel mesh to protect the wearer against snake bites. U.S. Pat. No. 3,758,963 issued to Knight on Sep. 18, 1973 discloses a snake protective device having hinged semi-cylindrical halves and made of aluminum, plastic, or the like.

While most rigid leggings are effective at protecting against snake bites, they have a number of undesirable qualities. For instance, they are generally uncomfortable to wear. In addition, they tend to be rather noisy, since the protective leggings will often knock against one another as the wearer walks. This is undesirable when the person wearing the leggings is hunting, as the clacking noise can scare away game or otherwise alert game to the hunter's presence. Moreover, due to their rigid construction, these devices have tended to cover only the lower portion of the wearer's legs, rather than the entire length of the wearer's legs.

In an attempt to overcome these drawbacks, protective leggings or chaps have been developed using textile materials, rather than a rigid material. Each chap generally comprises a tubular leg enclosure of a tough textile material, such as canvas or cordura nylon. The leg enclosure surrounds the leg from ankle to upper thigh, and is suspended at its upper end from the wearer's belt. The leg enclosure includes a slit at its bottom, allowing the legging to easily slipped on and off of the leg over the wearer's boots or shoes. A zipper is typically provided along the length of the slit for closing the slit once the legging is in place. For instance, U.S. Pat. No. Re. 32,506, issued to Hightower, discloses a legging or chap made of a cordura nylon basket weave fabric, coated with polyurethane.

These fabric leggings are more flexible, and thus more comfortable, than rigid leggings. They can also be designed to cover the entire length of the leg, since they are capable of bending with the wearer's leg during a normal walking motion. However, they nonetheless have several deficiencies. For instance, the materials that have typically been used, including cordura nylon material, are relatively noisy as the leggings rub together. The fabrics also tend to stiffen in freezing temperature, making the legging uncomfortable.

Moreover, it has been found that the use of zippers to close the slit at the bottom of each legging has several distinct drawbacks. Most notably, the zippers tend to jam or clog when the chap is exposed to dirt, sand or other particulate matter, making it difficult to open or close the zipper. In a worst case scenario, the zipper can become stuck or jammed, leaving the slit wide open, leaving the lower portion of the wearer's legs unprotected from snake bite. This is particularly troublesome given that the majority of snake strikes, especially those from smaller snakes, are directed at the lower portion of the person's leg. Thus, when a zipper fails for one reason or another, it can leave exposed the portion of the body that is most likely to be targeted by a snake strike.

Accordingly, it would be a great benefit to have a snake-proof legging that solves the aforementioned disadvantages of prior art designs. Such a legging should be made of a material that is durable and flexible, and will retain its flexibility through a wide range of temperatures, including freezing temperatures. The legging should also be lightweight, while providing protection against even the most aggressive snake strikes. The legging should also be easy to install and remove, with a slit-closure system that is easy to operate and is not prone to jamming from dirt, sand or other particulate matter.

SUMMARY OF THE INVENTION

These and a number of additional objects are met by the present invention. In a basic aspect, the invention is an improved legging or chap for protecting a wearer's leg against snake bite, wherein the chap is made of a spun polyester duck fabric having a weight between about 14–16 ounces per square yard, coated on its inner surface with a neoprene coating. This particular material has been found to provide excellent protection against fang penetration, while retaining its flexibility through a wide range of temperatures, including extremely cold temperatures. The fabric has also been found to be more quiet than previous fabrics used to make snake-proof leggings.

Each chap comprises a leg enclosure that is generally tubular in shape, with an opening at each of its lower and upper ends, allowing the leg enclosure to be slipped completely onto the wearer's leg. A strap is connected to the upper end of the leg enclosure, for suspending the chap from the wearer's belt.

A slit is provided in the lower portion with the leg enclosure, allowing the bottom portion to be opened up so that the chap can be easily slipped onto and off of the wearer's leg, over his or her boots or shoes. A plurality of snaps are provided on the leg enclosure on each side of the slit, for closing the slit. Unlike zippers, the snaps are not prone to clogging or jamming when the chap is exposed to sand, dirt or other particulate matter. To prevent a snake from striking through the slit between adjacent snaps, the leg enclosure includes a flap attached to the inner surface of the leg enclosure and extending along the length of the slit, the flap having sufficient width to overlap the opposing side edges of the slit when the slit is closed.

BRIEF DESCRIPTION OF THE DRAWINGS

FIG. 3 is a medial side view of the chap of FIG. 1

FIG. 4 is a cross-sectional view of the chap of FIG. 2, taken along the line 4—4 of FIG. 2.

FIG. 5 is similar to the view shown in FIG. 4, with the slit in the closed position.

DETAILED DESCRIPTION OF PREFERRED EMBODIMENTS

Figure 1:
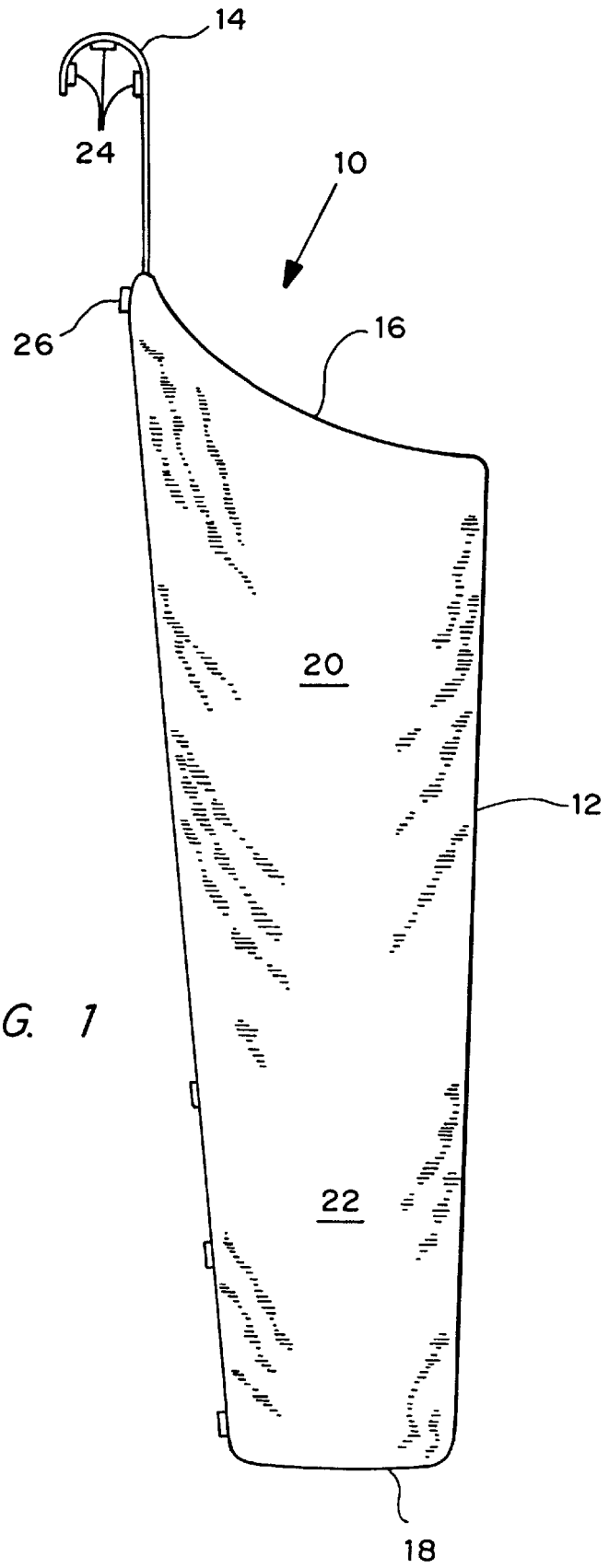
FIG. 1 is a front view of a snake-proof chap made in accordance with the present invention.
Figure 2:
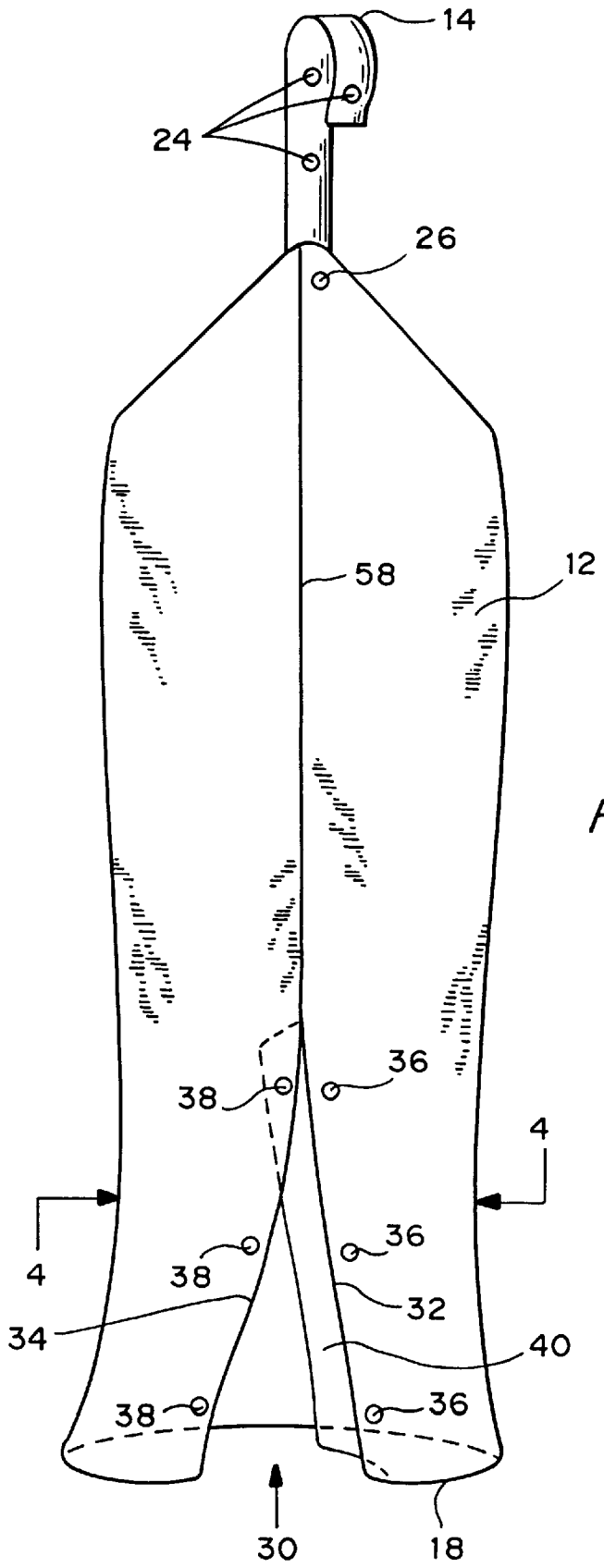
FIG. 2 is a lateral side view of the chap of FIG. 1

Turning to FIGS. 1–6, the details of various preferred embodiments of the present invention are shown. As shown in FIGS. 1–3, a snake-proof chap 10 made in accordance with the present invention comprises a tubular leg enclosure 12 and a strap 14 for suspending the leg enclosure from a wearer's belt or other structure. In use, two individual chaps are worn by the wearer, one on each leg. Since the details of construction are the same for each of the two chaps, the invention is described by reference to a single chap, with the understanding that the second chap is a mirror image of the first chap. The particular chap shown in the drawings is adapted to be worn on the wearer's right leg.

The leg enclosure is made of a spun polyester duck fabric. The fabric preferably has a weight between about 14 and 16 ounces per square yard of material, and most preferably about 14¾ ounces per yard of material, with a thread count of 51×27 threads per square inch and a 12/3×12/3 warp and fill. The inner surface of the fabric (i.e., the side that forms the inner surface of the leg enclosure) is coated with about neoprene, preferably in an amount of about 1½ ounces of neoprene per yard of fabric.

Referring in particular to FIG. 1, the leg enclosure has an open upper end 16 and an open lower end 18, and generally includes an upper portion 20 for surrounding the upper portion of the wearer's leg (i.e., the portion of the leg above the wearer's knee), and a lower portion 22 for surrounding the lower portion of the wearer's leg (i.e., the portion of the leg below the wearer's knee). Since the wearer's thigh is generally thicker than his or her lower leg, the leg enclosure has a slight downward taper, such that the upper end 16 is slightly wider than the lower end 18. At the upper end of the leg enclosure, the lateral side of the enclosure (i.e., the side that covers the outer surface of the leg) extends higher than the medial side of enclosure (i.e., the side that covers the inner surface of the leg). This provides protection for the outer portion of the wearer's upper thigh, while at the same time allowing the inner portion of the leg enclosure to fit comfortably within the wearer's crotch.

The strap 14 is attached to the upper lateral end of the enclosure 12. A plurality of male or female snap elements 24, preferably three in number, are attached to the strap along its length, and a corresponding female or male snap element 26 is attached to the top, outer surface of the leg enclosure 12. When the leg enclosure has been slipped over the wearer's leg, the strip 14 is passed over the wearer's belt, and one of the snap elements 24 is mated to the corresponding snap element 26 to form a closed loop about the wearer's belt, suspending the leg enclosure 12 from the belt at a desired level.

The enclosure can be made in a variety of lengths, depending on the size of the wearer's legs. Preferably, the enclosure should extend from the wearer's crotch and upper thigh to the top of the wearer's boot or shoe, to provide complete protection along the entire length of the wearer's leg.

As best shown in FIG. 2, the leg enclosure 12 includes a slit 30 on the lateral side of the lower portion 22 of the enclosure 12. The slit 30 has a first edge 32 and a second edge 34, and extends upward from the lower end 18, preferably for a distance of at least about 12 to 15 inches. When opened, the slit allows the chap to be easily slipped onto or off of the wearer's leg, over his or her boot or shoe.

A plurality of snaps are provided along the length of the slit 30, for closing the slit when the chap has been slipped onto the wearer's leg. Each snap includes a first snap element 36 attached to the enclosure along the first edge 32 of the slit 30 and a corresponding second snap element 38 attached to the enclosure on the opposite edge 34 of the slit 30. Each first snap element is adapted to detachably engage the corresponding second snap element 38 on the opposite side of the slit 30 in a well known manner, to close the slit 30. Preferably, there are three snap assemblies, each made of anodized brass.

As best shown in FIGS. 2, 4 and 5, to prevent a snake from striking through the slit 30 between adjacent snaps, the leg enclosure 12 includes a flap 40 that extends from the inner surface of the leg enclosure 12, along the length of the slit 30. The flap 40 has sufficient width to overlap the opposing side edges of the slit 30 when the slit 30 is closed by fastening the first and second snap elements 36 and 38 to one another. As shown in FIG. 5, when the snap elements 36 and 38 are fastened in place, the first edge 32 of the slit 30 will overlap the second edge 34 of the slit 30, with the second edge 34 being sandwiched between the first edge 32 and the flap 40 to ensure complete closure and protection along the length of the slit 30.

Figure 6:
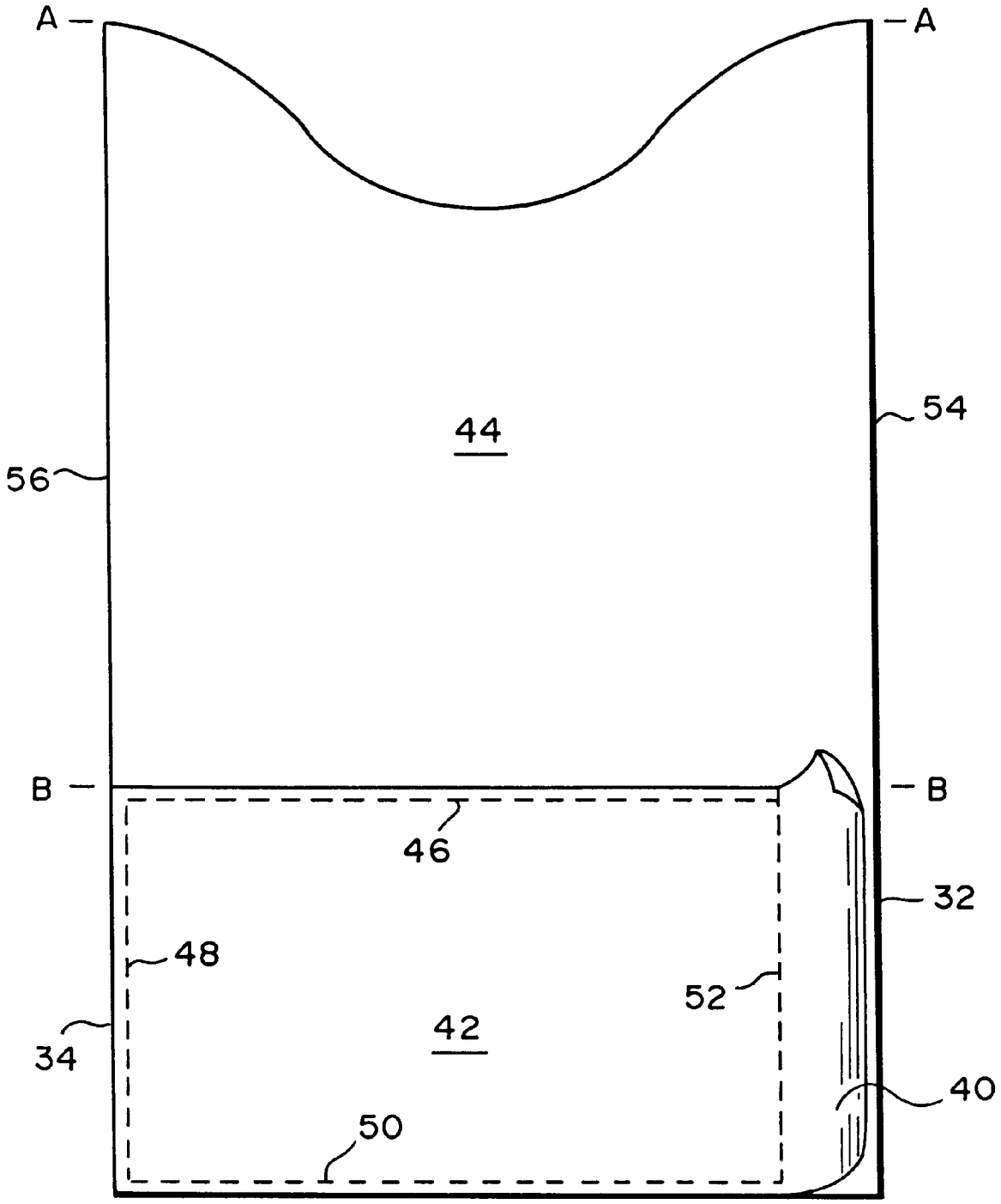
FIG. 6 is a plan view of the fabric used to make the embodiment of FIGS. 1–5, prior to formation of the fabric into the final embodiment.

In a particularly preferred embodiment, best shown in FIG. 6, the lower portion 22 of the enclosure 12 includes a second layer of fabric 42, preferably of the same spun polyester duck fabric, stitched to the inner surface of the enclosure 12. The second layer of fabric 42 imparts additional strength and durability to the lower portion of the leg enclosure, the portion that is most likely to rub against rocks, branches and other such objects as the wearer walks. The second layer 42 also provides additional protection against snake strikes that are directed at the wearer's lower leg. This additional protection is particularly important since the majority of snake strikes, particularly by smaller snakes (which tend to have the sharpest fangs) are directed at the person's lower leg.

As shown in FIG. 6, the second layer 42 of fabric is stitched to the inner surface 44 of the enclosure by lines of stitching 46, 48, 50 and 52. As will be readily recognized by persons of skill in the art, the particular dimensions of the first and second layers of fabric will depend on the desired size and shape of the final finished product. The line of stitching 52 is recessed inward from the adjacent edge of the second layer of fabric 42, such that the fabric lying between the adjacent edge of the fabric and the row of stitching 52 will form the flap 40. After the second layers of fabric 42 has been stitched to the inner surface 44 of the leg enclosure 12, the edges 54 and 56 of the assembly are stitched together between points A and B to form the tubular leg extension shown in FIG. 1. The resulting seam is shown as element 58 in FIG. 2.

The completed chap assembly is durable, and comfortable to wear. In addition, as shown in the following Examples, the chap assembly retains its flexibility even in extremely cold conditions, and prevents penetration of snake fangs much more effectively than prior art designs.

EXAMPLE 1

A snake proof chap made in accordance with the present invention, comprising a spun polyester duck fabric having a weight of about 14¾ ounces per yard of material, with a thread count of 51×27 threads per square inch and with a 12⅔×12⅔ warp and fill, with a 1½ ounces per square yard coating of urethane on its inner surface, was placed into a freezer and kept in the freezer for a period of about 6 months at a temperature of about 0 degrees Fahrenheit. For comparative purposes, a prior art chap comprising a 1000 dernier cordura nylon material with a polyurethane coating was also placed into the same freezer for the same period. When the chaps were removed, the chap of spun polyester duck had excellent flexibility, similar to the flexibility exhibited at normal ambient temperatures. The chap of cordura nylon was stiff and rigid, having lost much of its normal flexibility.

EXAMPLE 2

The materials used to make the chaps of Example 1 were tested in a needle penetration test, to determine their relative penetrability in a simulated snake-strike. A swatch of each material was stretched across a rigid cylindrical ring, approximately 6 inches in diameter, providing a flat, circular elevated sample of each fabric. A standard household sewing machine needle, weighted by a known weight, was dropped a fixed distance onto each fabric sample to determine whether the needle would penetrate the fabric. If the needle did not penetrate the fabric, the procedure was repeated again on a different region of the sample, with an increased amount of weight on the needle. This procedure was repeated for each fabric until the needle penetrated the fabric. Using this procedure, it was found that the weight required to force the needle through the spun polyester duck fabric was approximately 53% greater than the weight required to force the same needle through the cordura nylon material.

While the invention has been described above with respect to various preferred embodiments, persons of skill in the art will readily understand that various modifications can be made to those embodiments without departing from the true scope and spirit of the invention as set forth in the following claims.

What is claimed is:

1. A protective chap for protecting a wearer against snake bite, said chap comprising a generally tubular leg enclosure having an outer surface, an inner surface, an open lower end and an open upper end, the leg enclosure generally comprising an upper portion terminating at the upper end of the enclosure, a lower portion terminating at the lower end of the enclosure, a slit defined by first and second opposite side edges in the lower portion of the enclosure and means for connecting the first and second side edges to one another to close the slit, the chap further comprising a flap attached to the inner surface of the leg enclosure and extending along the length of the first side edge, the flap having sufficient width to overlap the first and second side edges when the slit is closed, the lower portion of the leg enclosure comprising a second layer of spun polyester fabric, forming a double layer of fabric, wherein the second layer of fabric is stitched to the inner surface of the leg enclosure, with a free edge of the second layer of fabric forming the flap.

2. The chap of claim 1 comprising means connected to the upper end of the leg enclosure for suspending the leg enclosure from a belt worn about the wearer's hips.

3. The chap of claim 2 wherein the means for suspending the leg enclosure comprises a flexible strap connected at one end to the upper end of the leg enclosure.

4. A protective chap for protecting a wearer's legs against snake bite, comprising a) a generally tubular leg enclosure having an outer surface, an inner surface, an open lower end and an open upper end, the enclosure generally comprising an upper portion terminating at the upper end of the enclosure for enclosing the wearer's leg above the wearer's knee and a lower portion terminating at the lower end of the enclosure for enclosing the wearer's leg below the wearer's knee, wherein the upper portion of the enclosure comprising a single layer of spun polyester fabric having a weight between about 14 and 16 ounces per square yard of fabric with a coating of about 1½ ounces per square yard of neoprene on the inner surface of the fabric and the lower portion of the leg enclosure comprises a double layer of fabric, at least one of said layers comprising a spun polyester fabric having a weight between about 14 and 16 ounces per square yard of fabric, the lower portion of the leg enclosure having a slit therein defined by first and second opposite side edges, the slit extending from the lower opening towards the upper portion of the leg enclosure, the leg enclosure further comprising a flap attached to the inner surface of the leg enclosure and extending along the length of the first side edge, the flap having sufficient width to overlap the first and second side edges when the slit is closed; and b) a plurality of snaps for closing the slit, each snap comprising a first portion attached to the leg enclosure on one side of the slit and a second portion, detachably matable with the first portion, attached to the leg enclosure on the opposite side of the slit.

* * * * *